United States Patent [19]

Lomas et al.

[11] Patent Number: 4,541,923

[45] **Date of Patent: * Sep. 17, 1985**

[54] CATALYST TREATMENT AND FLOW CONDITIONING IN AN FCC REACTOR RISER

[75] Inventors: David A. Lomas, Arlington Heights; Harold U. Hammershaimb, Western Springs, both of Ill.

[73] Assignee: UOP Inc., Des Plaines, Ill.

[ * ] Notice: The portion of the term of this patent subsequent to Oct. 30, 2001 has been disclaimed.

[21] Appl. No.: 672,637

[22] Filed: Nov. 19, 1984

Related U.S. Application Data

[63] Continuation-in-part of Ser. No. 651,507, Sep. 17, 1984, , which is a continuation-in-part of Ser. No. 584,681, Feb. 29, 1984, Pat. No. 4,479,870.

[51] Int. Cl.[4] ..... C10G 11/18

[52] U.S. Cl. ..... 208/164; 208/113; 208/120; 208/153

[58] Field of Search ..... 208/164, 113, 120, 153, 208/108, 52 LT

[56] References Cited

U.S. PATENT DOCUMENTS

| | | | |
|---|---|---|---|
| 3,886,060 | 5/1975 | Owen | 208/74 |
| 3,894,932 | 7/1975 | Owen | 208/74 |
| 4,404,090 | 9/1983 | Castillo et al. | 502/55 |
| 4,417,975 | 11/1983 | Myers et al. | 208/164 |
| 4,419,221 | 12/1983 | Castagnos et al. | 208/164 |
| 4,422,925 | 12/1983 | Williams et al. | 208/75 |
| 4,440,629 | 4/1984 | Stine | 208/112 |
| 4,440,632 | 4/1984 | Vasalos et al. | 208/164 |
| 4,447,552 | 5/1984 | Hayes et al. | 502/34 |
| 4,479,870 | 10/1984 | Hammershaimb et al. | 208/164 |

*Primary Examiner*—D. E. Gantz
*Assistant Examiner*—Anthony McFarlane
*Attorney, Agent, or Firm*—Thomas K. McBride; William H. Page, II; John G. Tolomei

[57] ABSTRACT

A process for converting a charge stock comprising normally liquid hydrocarbons in a riser conversion zone with an active fluid catalytic cracking catalyst wherein a suspension of hot regenerated active fluid catalytic cracking catalyst in a lift gas comprising hydrocarbons including not more than 10 mole % $C_3$ and heavier hydrocarbons (calculated on a water-free basis) is passed through a first treatment section of the riser conversion zone at conditions selected to treat the catalyst prior to any contact with the charge stock while simultaneously accelerating the catalyst to a velocity sufficient to provide turbulent dilute flow at the point of contact with the charge stock; thereafter a charge stock is introduced into the suspension of treated particles in the riser conversion zone downstream of the treatment section to form a mixture of catalyst, charge stock and lift gas having the catalyst relatively uniformly distributed therethrough. The charge stock is then reacted with the catalyst in the remaining downstream section of said riser conversion zone at reaction conditions sufficient to effect the desired conversion.

10 Claims, No Drawings

CATALYST TREATMENT AND FLOW CONDITIONING IN AN FCC REACTOR RISER

CROSS REFERENCE TO RELATED APPLICATIONS

This application is a continuation-in-part of prior copending application Ser. No. 651,507 filed Sept. 17, 1984, incorporated herein by reference which is a continuation-in-part of prior copending application Ser. No. 584,681 filed Feb. 29, 1984 now U.S. Pat. No. 4,479,870.

BACKGROUND OF THE INVENTION

1. Field of the Invention

The field of art to which the claimed invention pertains is the fluid catalytic cracking of hydrocarbons. More specifically, the claimed invention relates to a process for the fluid catalytic cracking of hydrocarbons where a particular type of gaseous material is introduced into the reactor riser upstream of the introduction of the feed stream to be cracked in order to accomplish selective carbonization of active sites on the catalyst while accelerating the catalyst to a velocity sufficient to provide excellent catalyst-feed interaction at the point of feed introduction.

2. Background Information

There are a number of continuous cyclical processes employing fluidized solid techniques in which carbonaceous materials are deposited on the solids in the reaction zone and the solids are conveyed during the course of the cycle to another zone where carbon deposits are at least partially removed by combustion in an oxygen-containing medium. The solids from the latter zone are subsequently withdrawn and reintroduced in whole or in part to the reaction zone.

One of the more important processes of this nature is the fluid catalytic cracking (FCC) process for the conversion of relatively high-boiling hydrocarbons to lighter hydrocarbons boiling in the heating oil or gasoline (or lighter) range. The hydrocarbon feed is contacted in one or more reaction zones with the particulate cracking catalyst maintained in a fluidized state under conditions suitable for the conversion of hydrocarbons.

Obtaining the desired reaction products from a fluidized catalytic cracking zone demands proper interaction of the catalyst and the feed stream. A proper interaction will bring the catalyst having the desired activity and selectivity characteristics into contact with all feed molecules for a uniform period of time so that the most beneficial product stream is obtained without causing undue production of undesired products such as light gases and coke. Consequently, optimizing FCC operation presents chemical problems in regard to controlling activity and selectivity of the catalyst and physical problems in terms of uniformly contacting the feed with catalyst and maintaining the same period of catalyst contact for the continuously entering feed, thereby avoiding undesired side reactions such as over-cracking.

There are many references which teach, for reasons of controlling catalyst properties or catalyst flow distribution, the mixing of hot regenerated FCC catalyst with various relatively light materials prior to contact of the catalyst with the FCC feedstock. Thus, in U.S. Pat. No. 3,042,196 to Payton et al., beginning wdth a light cycle oil, progressively heavier components are added to an upflowing catalyst stream in a reactor riser so as to use a single catalyst and a single cracking zone to convert the elements of a crude oil. In U.S. Pat. No. 3,617,497 to Bryson et al. a light gas oil is mixed with a diluent vapor such as methane or ethylene at or near the bottom of a reactor riser with hot regenerated catalyst, introduced at the same point in the riser or very close downstream, with the mixture then contacted with heavy gas oil at the top of the riser so as to enhance gasoline yield. In U.S. Pat. No. 3,706,654 to Bryson et al., naphtha diluent may be added to the bottom of a reactor riser to aid in carrying upwardly into the riser the regenerated catalyst stream. In U.S. Pat. No. 3,849,291 to Owen it is disclosed that a gasiform diluent material comprising $C_4+$ hydrocarbons and particularly $C_5+$ hydrocarbons may be used to form a suspension with freshly regenerated catalyst which suspension is caused to flow through an initial portion of a riser reactor before bringing the hydrocarbon reactant material in contact therewith in a downstream portion of the reactor so as to achieve a very short residence time (1 to 4 seconds) that the hydrocarbon is in contact with the catalyst suspension in the riser reactor (catalyst residence time). U.S. Pat. No. 3,894,932 to Owen discusses contacting the FCC conversion catalyst with a $C_3$–$C_4$ rich hydrocarbon mixture or an isobutylene rich stream before contact with gas oil boiling range feed material in an initial portion of the riser (catalyst to hydrocarbon weight ratio from 20 to 80) so as to upgrade the $C_3$–$C_4$ material to a higher boiling material.

U.S. Pat. No. 4,422,925 to Williams et al. discusses passing a mixture of hydrocarbons, such as ethane, propane, butane, etc., and catalyst up through a riser reactor at an average superficial gas velocity within the range from about 40 to about 60 feet per second (12.2–18.3 meters/sec), with a catalyst to hydrocarbon weight ratio of about 5 to about 10 so as to produce normally gaseous olefins. In U.S. Pat. No. 4,427,537 to Dean et al. there is shown catalyst particles mixed with a fluidizing gas, such as a gaseous hydrocarbon, charged to a bottom portion of a reactor riser to promote or provide for a smooth non-turbulent flow up the riser of a relatively low velocity dense flow of catalyst particles.

There are additional references which show use of a lift gas in non-catalytic systems. For example, in U.S. Pat. No. 4,427,538 to Bartholic, a gas which may be a light hydrocarbon is mixed with an inert solid at the bottom part of a vertical confined conduit and a heavy petroleum fraction is introduced at a point downstream so as to vary the residence time of the petroleum fraction in the conduit. Similarly, in U.S. Pat. No. 4,427,539 to Busch et al., a $C_4$ minus gas is used to accompany particles of little or no catalytic activity up a riser upstream of charged residual oil so as to aid in dispersing the oil.

Finally, it is taught in U.S. Pat. Nos. 4,364,848, 4,382,015, and 4,404,090 to Castillo et al. and 4,325,811 to Sorrentino that passivation of contaminating metals on an FCC catalyst may be effected by contacting hot regenerated catalyst with hydrogen and/or light hydrocarbon gas.

The process of the present invention, in contradistinction to the teachings of the above references, comprises a novel method of introducing a lift gas composition especially suited for treatment of a regenerated FCC catalyst in an FCC process in a manner that will simultaneously beneficially condition the catalyst prior to contact with feed and deliver the treated particles to the reaction zone in a flow regime which provides excellent catalyst and feed interaction.

The primary objective of the present invention is to provide an efficient method for selectively conditioning and delivering regenerated FCC catalyst to an FCC reaction zone such that the yield of desired products is maximized.

SUMMARY OF THE INVENTION

In its broadest embodiment, the present invention comprises a process for converting a charge stock comprising normally liquid hydrocarbons in a riser conversion zone with an active fluid catalytic cracking catalyst which comprises (a) passing a suspension consisting essentially of hot regenerated active fluid catalytic cracking catalyst in a lift gas comprising hydrocarbons including not more than 10 mole % $C_3$ and heavier hydrocarbons (calculated on a water-free basis) through an upstream treatment section of a riser conversion zone at treatment conditions selected to selectively carbonize reaction sites on the catalyst prior to any contact with the charge stock while simultaneously accelerating the catalyst to a velocity sufficient to provide turbulent dilute flow at the point of contact with the charge stock; and (b) introducing the charge stock into the upflowing suspension at a vertically oriented locus in the riser conversion zone downstream of the treatment portion to form a mixture of catalyst, charge stock and lift gas having the catalyst relatively uniformly distributed therethrough and thereafter reacting the charge stock with the catalyst in the remaining downstream portion of the riser conversion zone at reaction conditions sufficient to effect the desired conversion.

In a more limited embodiment, the present invention comprises a process for converting normally liquid hydrocarbons in a vertically oriented riser conversion zone with an active fluid catalytic cracking catalyst which comprises: (a) passing an upflowing suspension of hot regenerated active fluid catalytic cracking catalyst in a lift gas comprising hydrocarbons including not more than 10 mole % $C_3$ and heavier hydrocarbons (calculated on a water-free basis) through a treatment section of a vertically orientated riser conversion zone at a gas velocity of from about 1.8 to less than 12.2 meters per second, and for a catalyst residence time from about 0.5 to about 15 seconds, the weight ratio of catalyst to hydrocarbon in the lift gas being greater than 80; and (b) introducing the charge stock into the upflowing suspension at a locus in the riser conversion zone downstream of the treatment portion to form a mixture of catalyst, charge stock and lift gas having the catalyst relatively uniformly distributed therethrough and thereafter reacting the charge stock with the catalyst in the remaining downstream portion of the riser conversion zone.

Other embodiments of the present invention encompass details as to lift gas compositions and reaction conditions, all of which are hereinafter disclosed in the following discussions of each of the facets of the present invention.

DESCRIPTION OF THE INVENTION

In a typical FCC process flow, finely divided regenerated catalyst leaves the regeneration zone at a certain temperature and contacts a feedstock in a lower portion of a reactor riser zone. While the resulting mixture, which has a temperature of from about 200° C. to about 700° C., passes up through the riser, conversion of the feed to lighter products occurs and coke is deposited on the catalyst. The effluent from the riser is discharged into a disengaging space where additional conversion can take place. The hydrocarbon vapors, containing entrained catalyst, are then passed through one or more cyclone separation means to separate any spent catalyst from the hydrocarbon vapor stream. The separated hydrocarbon vapor stream is passed into a fractionation zone known in the art as the main column wherein the hydrocarbon effluent is separated into such typical fractions as light gases and gasoline, light cycle oil, heavy cycle oil and slurry oil. Various fractions from the main column can be recycled along with the feedstock to the reactor riser. Typically, fractions such as light gases and gasoline are further separated and processed in a gas concentration process located downstream of the main column. Some of the fractions from the main column, as well as those recovered from the gas concentration process may be recovered as final product streams. The separated spent catalyst passes into the lower portion of the disengaging space and eventually leaves that zone passing through stripping means in which a stripping gas, usually steam, contacts the spent catalyst purging adsorbed and interstitial hydrocarbons from the catalyst. The spent catalyst containing coke leaves the stripping zone and passes into a regeneration zone where, in the presence of fresh regeneration gas and at a temperature of from about 620° C. to about 760° C., a combustion of coke produces regenerated catalyst and flue gas containing carbon monoxide, carbon dioxide, water, nitrogen and perhaps a small quantity of oxygen. Usually, the fresh regeneration gas is air, but it could be air enriched or deficient in oxygen. Flue gas is separated from entrained regenerated catalyst by cyclone separation means located within the regeneration zone and separated flue gas is passed from the regeneration zone, typically, to a carbon monoxide boiler where the chemical heat of carbon monoxide is recovered by combustion as a fuel for the production of steam, or, if carbon monoxide combustion in the regeneration zone is complete, which is the preferred mode of operation, the flue gas passes directly to sensible heat recovery means and from there to a refinery stack. Regenerated catalyst which was separated from the flue gas is returned to the lower portion of the regeneration zone which typically is maintained at a higher catalyst density. A stream of regenerated catalyst leaves the regeneration zone, and as previously mentioned, contacts the feedstock in the reaction zone.

Looking now at this invention, the stream of catalyst that leaves the regenerator enters a conduit which comprises a riser conversion zone having two sections. A first section of the riser serves as the catalyst treatment section while a downstream portion performs the usual reaction function of an FCC riser.

Hot catalyst and lift gas enters the treatment section of the riser at its lowermost end point. Prior to contact with the lift gas medium, hot catalyst leaves the regenerator as a dense stream of particles flowing in a downward direction. Hence the catalyst particles entering the treatment section have, with respect to flow within the riser, either zero velocity or a negative velocity. In initially accelerating the particles, a high degree of turbulence and backmixing is inevitable. Performing the initial catalyst acceleration at or near the point of feed introduction will vary the residence time for feed entering the riser. By using only a lift gas to provide the initial upward impetus to the catalyst, this invention avoids one cause of maldistribution and variable retention times for the feed hydrocarbons. After initial catalyst entry into the riser, other phenomena of a fluidized stream can cause a variable residence time within the riser. One of these phenomena is slippage between the flowing gas and the catalyst particles which will occur due to differences in density and momentum of the particles and in a non-uniform manner due to variations in particle size. In addition, catalyst particles traveling close to the wall of the riser will experience extended residence times as a result of increased drag forces. These drag forces on the catalyst particles will increase with the density of the flowing stream. The present invention minimizes these problems by accelerating the catalyst in the treatment section of the riser to achieve dilute turbulent flow prior to feed introduction. Transporting the catalyst particles in dilute turbulent flow gives the various sizes of particles time to evenly accelerate so that a more uniform velocity is attained at point of feed introduction; results in reduced catalyst density which lowers overall drag forces; and provides some mixing of the catalyst to avoid a boundary region of slower moving catalyst particles near the wall of the riser. Accordingly, the treatment riser of this invention performs the significant function of overcoming substantial physical problems associated with particle flow before the feed contacts the catalyst.

As well known by those skilled in the art, establishing a regime of dilute turbulent flow is dependent on two variables -gas velocity and the quantity of catalyst flowing through the riser or catalyst flux. These two variables are interdependent in that a given catalyst flux requires a minimum gas velocity in order to maintain dilute phase flow. Of course a minimum gas velocity is necessary to effect turbulent transport of catalyst through the riser. A gas velocity of about 1.8 meters/-sec is usually the minimum velocity for operation of a riser in dilute phase flow that will still provide an adequate flux rate of catalyst. At a gas velocity of 1.8 meters/sec the maximum catalyst flux rate is approximately 5 $lb/ft^2/sec$. If this catalyst flux were increased without a simultaneous increase in gas velocity, catalyst in the riser would slump back into a dense phase mode, which phase is not in the flow regime essential to this invention. While there is theoretically no maximum gas velocity limitation for the riser treatment zone, various practical limitations exist. With increasing gas velocity, the sheer volume of gas moving through the reactor system and main colum increases. Consequences of the additional volume are higher utility costs and greater vessel size. In addition, higher velocities increase the erosive action of the flowing catalyst stream thereby by reducing equipment. Therefore, gas velocities within the riser will generally not exceed 24 meters/sec. However, a more desirable range of gas velocities for the treatment zone is from 1.8 to 12.2 meters/sec. For this range of velocities, the catalyst flux rate will usually not exceed 200 $lb/ft^2/sec$.

Catalysts which can be used in the process of this invention include those known to the art as fluidized catalytic cracking catalysts. Specifically, the high activity crystalline aluminosilicate or zeolite-containing catalysts can be used and are preferred because their higher resistance to the deactivating effects of high temperatures, exposure to steam, and exposure to metals contained in the feedstock. Zeolites are the most commonly used crystalline aluminosilicates in FCC.

In addition to establishing an advantageous flow regime for catalyst exiting the treatment section of the riser, the lift gas used in the present invention also performs the important function of reacting with the catalyst prior to feedstock introduction so as to enhance desired and suppress undesired catalytic properties. Specifically, we have found that a lift gas comprising hydrocarbons which when calculated on a water-free basis include not more than 10 mole % $C_3$ and heavier hydrocarbons will react with active contaminating metal sites on the catalyst to reduce hydrogen and coke production effects of these metal sites and will selectively carbonize acid sites on the catalyst, thus leading to greater selectivity for desired products and lower coke and light gas yield from a hydrocarbon charge. Aside from the usual addition of water or steam, the lift gas may contain reaction species such as $H_2$, $H_2S$, $N_2$, CO and/or $CO_2$.

The advantages of reduced coke and dry gas yield associated with selective carbonization along with the improved flow distribution for catalyst exiting the treatment section will benefit a typical FCC unit when processing the usual heavy FCC feedstock. Thus this invention has application to the processing of vacuum gas oils and other typical FCC charge stocks.

However, this invention is particularly useful for FCC units processing heavy or residual charge stocks, i.e., those boiling above 900° F., which frequently have a high metals content and which cause a high degree of coke deposition on the catalyst when they crack. Contaminant metals such as nickel, iron, cobalt and vanadium found in the charge stock usually influence the regeneration operation, catalyst selectivity, catalyst activity and the fresh catalyst makeup required to maintain a constant activity. Metals contained in the feed are deposited on the catalyst and not only change its selectivity in the direction of less gasoline and more coke and light gas in a given reactor system, but tend to deactivate the catalyst. These excessive amounts of coke and gas create what are sometimes insurmountable problems such as exceeding the regenerator capacity as well as the capacity of the gas concentration facilities. Another problem with these types of feedstocks, which are usually contaminated with the aforementioned undesirable metal contaminants, is the harmful influence of even minute amounts of these metals. These metals, and in particular nickel and vanadium, will contribute an undesirable activity to the catalyst on which they deposit which is responsible for the production of still more hydrogen and coke on the catalyst. The presence of large quantities of these metals may also block access to cracking sites and thus lower the activity of the catalyst.

The lift gas composition and treatment conditions called for by the present invention achieves minimization of the above undesirable characteristics inherent in the use of heavy or residual charge stocks. Although it is not known whether the lift gas has any effect on moving metals from blocked sites, the presence alone of the lift gas will effect reductions of the heavy hydrocarbon partial pressure which will in turn reduce coke deposition to some extent. Furthermore, in addition to carbonizing the acid sites on the catalyst, it has been found that the lift gas of this invention will selectively carbonize active contaminating metal sites on the catalyst to reduce the hydrogen and coke production effects of these metal sites.

Notwithstanding anything implied in the above to the contrary, however, it is strongly emphasized that the lift gas composition and the catalyst flow conditions have, to some extent, a direct effect on the cracking reactions in the riser downstream of the feed introduction, and the catalyst-lift gas velocity, upstream of the feed instroduction, to a certain degree, will also influence the cracking reactions. The point is that the entire reactor riser, upstream and downstream of where the feed is introduced, is an integrated system and all the parameters defining the present invention alone and in combination have direct and indirect effects on all reactions occurring throughout that system.

In regard to this interrelationship, there are several important features worth noting. First, it is essential that catalyst from the treatment section flow directly into the reaction section so that continuity of catalyst flow up the riser is maintained. However, the right amount of lift gas and the velocity of lift gas and catalyst up the riser will serve to tailor the temperature of the catalyst prior to feed introduction by sensible heat and reaction effects, and to provide acceleration of the catalyst in the direction of gas flow so that the catalyst is moving at a significant velocity by the time feed is introduced, thereby providing the previously discussed benefits of improved catalyst/heavy oil contacting, improved distribution, uniform catalyst residence time and reduced catalyst backmixing. Of course, in realizing the maximum benefit of this invention, various parameters may be optimized. An important parameter for optimization is the average superficial gas velocity in the catalyst treatment zone of from about 1.8 to less than 12.2 meters per second up the riser. The velocity of the lift gas may be easily adjusted, independent of the catalyst to hydrocarbon in lift gas ratio, by the inclusion therein of up to 80 mole % water (steam). Other parameters that influence the treatment of the catalyst and the flow of catalyst prior to feed introduction are catalyst residence time, and the weight ratio of catalyst to hydrocarbon in the lift gas-catalyst mixture. The optimum range of these conditions for this invention is a catalyst residence time in the treatment zone of from 0.5 to 15 seconds and a weight ratio of catalyst to hydrocarbon in the lift gas-catalyst mixture of greater than 80:1, with a value in the range of 100:1 to 800:1 being especially preferred. Since the catalyst and lift gas mixture will be transferred directly to the reaction zone of the riser, the exiting temperature of this stream must be sufficient to heat the feed stock to a temperature sufficient to carry out the cracking reaction. Suitable treatment temperatures maintained in the lower section of the riser will usually fall in the range of 500° C. to 800° C.

There are many possible sources of a suitable lift gas in the typical refinery, but two convenient sources would be well known to those skilled in the art as absorber gas from the FCC gas concentration facilities, or gas from the main column overhead receiver after it has been compressed through at least one stage of a compressor, treated for removal of heavy hydrocarbons and cooled.

The reactor riser configuration for practice of the process of the present invention in its simplest form would comprise a vertical conduit with lift gas injected into the bottom, hot regenerated catalyst flowing into the lift gas slightly above the point of lift gas injection and the feed injected at an appropriate point further downstream. However, this invention is not limited to vertical riser configurations or single flow path risers. It is possible that the lower treatment portion of the riser will be entirely contained within an angled or curved portion of the riser, or the treatment zone may begin in an angled portion of riser and terminate in a vertical riser section. Also contemplated is a riser having a first horizontal treatment section through which catalyst and lift flow before contacting the feed in a vertical riser section. In terms of riser internals another possibility would be for the feed to flow cocurrently up the lower portion of the riser separated from the catalyst and lift gas by a partition or baffle plate where upon entering the reaction section the two streams would merge. The partition could be in the form of an annular portion through which the lift gas and catalyst would flow before being combined at the appropriate time with feed traveling up the central portion.

The following non-limiting Example is illustrative of FCC operations in accordance with the process of our invention as compared with operations not using a lift gas and using a lift gas not within the scope of the present invention.

EXAMPLE

For this example, the process of the present invention was used in a first run followed by a run in which the lift gas used was of a composition including heavy components which removed the process illustrated by that run from the scope of the present invention. Following is the data for those two runs including relevant operating conditions. The feedstock for both runs was an atmospheric resid. Also included, for purposes of comparison, is a calculated run representing the results that would be obtained using no lift gas and a feedstock and conditions, where applicable, identical to the first run.

| Run | 1 Present Invention | 2 Heavy Lift Gas | 3 Predicted |
|---|---|---|---|
| Feedstock | — | Atmospheric Resid | — |
| Lift Gas (mol % dry basis) | | | N.A. |
| $N_2$ | 6.0 | 5.6 | |
| CO | 1.1 | trace | " |
| $CO_2$ | 1.3 | 0.7 | " |
| $H_2S$ | 2.9 | — | " |
| $H_2$ | 19.8 | 18.4 | " |
| $C_1$ | 35.2 | 14.0 | " |
| $C_2$ (total) | 24.0 | 14.2 | " |
| $C_3$ (total) | 5.0 | 19.5 | " |
| $C_4$ (total) | 4.1 | 18.0 | " |
| $C_5$ (total) | 0.6 | 9.6 | " |
| $H_2O$ (mol % of lift gas) | 50.0 | 50.0 | " |
| Conditions | | | |
| Gas Velocity up riser (m/sec) | 5.79 | 5.79 | |
| Catalyst Residence time, lower portion (sec) | 11 sec | 11 sec | |
| Catalyst/lift gas hydrocarbon (kg/kg) | 400 | 400 | |
| Temperature lift gas/catalyst mixture | 710° C. | 710° C. | |
| Yields | | | |
| Dry gas (wt. %) | 2.6 | 6.6 | 4.7 |
| $C_3 + C_4$ (LV %) | 22.5 | 14.5 | 22.3 |
| Gasoline (180° C. w 90%, LV %) | 56.1 | 56.3 | 55.8 |
| Light cycle oil (LV %) | 15.8 | 17.5 | 14.3 |
| Clarified oil (LV %) | 11.4 | 8.9 | 10.3 |
| Coke (wt. %) | 10.0 | 11.3 | 10.2 |

The above data shows the criticality of the lift gas composition having no more than a small amount of heavier components. The increases in dry gas and coke yield with the use of the heavier lift gas is quite pronounced. We believe that the yields of gasoline and light cycle oil obtained by the practice of the present invention could be improved without significantly increasing coke or dry gas make by further optimization of the process.

In addition, a comparison of the no lift gas case demonstrates the advantages of utilizing a lift gas stream.

We claim as our invention:

1. A process for converting a charge stock comprising normally liquid hydrocarbons in a riser conversion zone with an active fluid catalytic cracking catalyst which comprises:

(a) passing suspension consisting essentially of hot regenerated active fluid catalytic cracking catalyst in a lift gas comprising hydrocarbons including not more than 10 mole % $C_3$ and heavier hydrocarbons (calculated on a water-free basis) through a first treatment section of said riser conversion zone at treatment conditions selected to selectively carbonize reaction sites on the catalyst prior to any contact with the charge stock while simultaneously accelerating the catalyst to a velocity sufficient to provide turbulent dilute flow at the point of contact with the charge stock; and, (b) introducing said charge stock into said suspension at a locus in said riser conversion zone downstream of said treatment section to form a mixture of catalyst, charge stock and lift gas having the catalyst relatively uniformly distributed therethrough and thereafter reacting the charge stock with the catalyst in the remaining downstream section of said riser conversion zone at reaction conditions sufficient to effect the desired conversion.

2. The process of claim 1 wherein the treatment conditions include a catalyst residence time in said treatment section of about 0.5 to 15 seconds, a temperature of about 500° to 800° C. and a weight ratio of catalyst to hydrocarbon in the lift gas greater than 80.

3. The process of claim 1 wherein the average superficial gas velocity of said lift gas in said treatment section is about 1.8 to less than 12.2 meters per second.

4. The process of claim 1 wherein said lift gas comprises up to about 80 mole % steam.

5. The process of claim 1 wherein said hot regenerated active fluid catalytic cracking catalyst is obtained from a fluid catalytic cracking unit regenerator and enters said treatment section at a temperature of about 620° C. to about 760° C.

6. The process of claim 1 wherein said lift gas also contains quantities of $H_2$, $H_2S$, $N_2$, CO or $CO_2$.

7. The process of claim 1 wherein said charge stock comprises a heavy residual feedstock.

8. The process of claim 1 wherein said riser conversion zone is vertically oriented.

9. The process of claim 8 wherein said treatment section is located in a lower portion of said vertically oriented riser conversion zone containing two axial flow spaces which are not in communication in the lower portion of said zone, wherein said catalyst and lift gas suspension flows upwardly in one of said flow spaces and wherein charge stock flows concurrent to said suspension in the other of said flow spaces merging at a locus appropriate to the introduction of said normally liquid hydrocarbons into said upflowing suspension.

10. The process of claim 9 wherein said lower portion of said vertically orientated riser conversion zone comprises two concentric tubular members providing an annular flow space and a central flow space which are not in communication in the lower portion of said zone, wherein said catalyst and lift gas suspension flows upwardly in said annular flow space and wherein said charge stock flows concurrent to said suspension up the central space of said riser.

* * * * *